US005818160A

United States Patent [19]

Ter Burg et al.

[11] Patent Number: 5,818,160

[45] Date of Patent: Oct. 6, 1998

[54] DEFLECTION UNIT WITH CLAMPING APPARATUS

[75] Inventors: Elisabeth L. M. Ter Burg; Urbanus P. M. Goossens; Hendricus J. P. Lenders, all of Eindhoven, Netherlands

[73] Assignee: U.S. Philips Corporation, New York, N.Y.

[21] Appl. No.: 498,279

[22] Filed: Jun. 30, 1995

[30] Foreign Application Priority Data

Jul. 4, 1994 [EP] European Pat. Off. ..... 94201916
Feb. 23, 1995 [EP] European Pat. Off. ..... 95200442

[51] Int. Cl.[6] ..... H01J 29/70

[52] U.S. Cl. ..... 313/444; 313/440; 335/210; 335/212; 335/213

[58] Field of Search ..... 313/444, 413, 313/440; 335/210, 212, 213; 348/829, 830, 831

[56] References Cited

U.S. PATENT DOCUMENTS

Re. 28,912 7/1976 Stade et al. .
3,500,270 3/1970 Anthony .
4,310,819 1/1982 Morita et al. .
4,310,956 1/1982 Meckstroth et al. .
5,350,968 9/1994 Kwon ..... 313/440

FOREIGN PATENT DOCUMENTS 6103925 4/1994 Japan ..... 313/440

*Primary Examiner*—Sandra L. O'Shea
*Assistant Examiner*—Joseph Williams
*Attorney, Agent, or Firm*—Robert J. Kraus

[57] ABSTRACT

A deflection unit for deflecting the electron beams in a cathode ray tube has a hollow coil support of a synthetic material. At one end, the support has projections around which a clamping apparatus is arranged for securing the deflection unit to the neck of the cathode ray tube. The clamping apparatus has projections located opposite each other, while their mutual distance determining the diameter of the clamping apparatus is adjustable by tightening a bolt. The ends of the projections are constructed in such a way that they support each other when the bolt is tightened.

7 Claims, 5 Drawing Sheets

DEFLECTION UNIT WITH CLAMPING APPARATUS

BACKGROUND OF THE INVENTION

The invention relates to a deflection unit for deflecting the electron beams in a cathode ray tube, which deflection unit comprises a hollow support of a synthetic material for supporting deflection coils, one end of said support being provided with projections around which a clamping means of the annular type is arranged for securing the deflection unit to a cathode ray tube.

In practice, the glass of the display tube neck may break when a deflection unit is secured to a tube with the aid of a clamping means. Even until 48 hours after the deflection unit has been secured, the neck glass may still break. Particularly the latter aspect is very detrimental, because the combination of display tube and deflection unit has initially been approved, while breakage occurs much later. Moreover, this problem occurs more and more frequently with the display tube windows getting bigger and flatter (particularly the 9:16 aspect ratio formats) for which larger, more complicated and hence heavier deflection units are required.

SUMMARY OF THE INVENTION

It is an object of the invention to provide a solution for reducing the risk of glass breakage.

This solution is characterized in that the clamping means has an open annular shape with a gap at a location on its circumference, at both sides of which gap bent parts of the clamping means outwardly extend as projections located opposite each other, in that the ends of the projections support each other, and in that an adjusting means with which the diameter of the clamping means can be adjusted is arranged between the ends of the projections and the gap.

The invention is based on the recognition that in the conventional clamping means of the annular type, a clamping force which is asymmetrical is exerted on the support, and via this support on the glass, when the bolt of the clamping means (the adjusting means) is tightened. This means that a peak stress which may lead to glass breakage occurs under the bent corners of the clamping means. By supporting the free ends of the projections on each other, it is achieved that the clamping force is exerted to a considerably more symmetrical extent. Consequently, the bent corners are not urged towards the support when the bolt is tightened, but moved away from the support. This effect is even enhanced if the material of the clamping means is a material which adjusts itself to the surface area of the projections of the support during clamping. Stainless steel, of which many conventional clamping means are manufactured, are not suitable for this purpose, at least not in the conventional thicknesses, but softer materials or materials having a lower yield stress such as brass, aluminium and beryllium-copper are suitable for this purpose. It is important that the material of the clamping means is brought towards its yield point during clamping.

BRIEF DESCRIPTION OF THE DRAWING

These and other aspects of the invention will be apparent from and elucidated with reference to the embodiments described hereinafter.

In the drawings.

DESCRIPTION OF THE PREFERRED EMBODIMENTS

Figure 1:
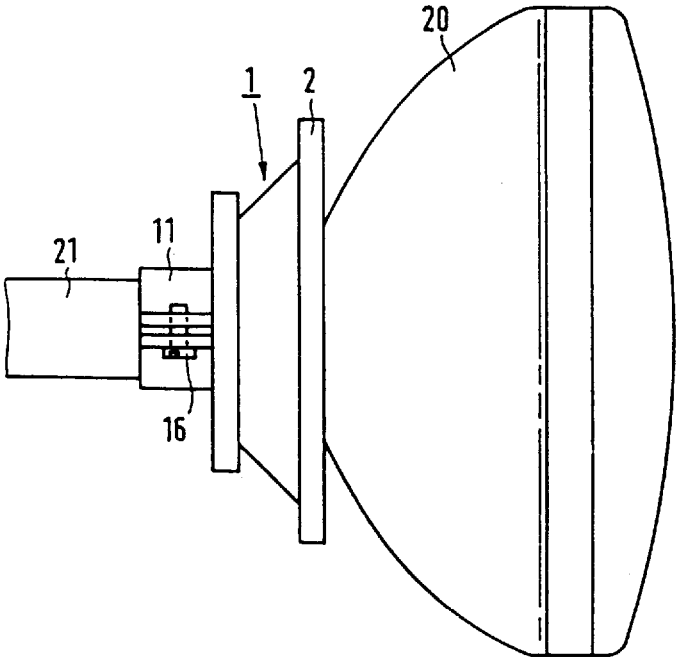
FIG. 1 is a diagrammatic side elevation of a display tube with a deflection unit secured thereto with the aid of a clamping means.

FIG. 1 shows a display tube 20 having a neck 21 on which a deflection unit 1 provided with a clamping means 11 is secured.

Figure 2:
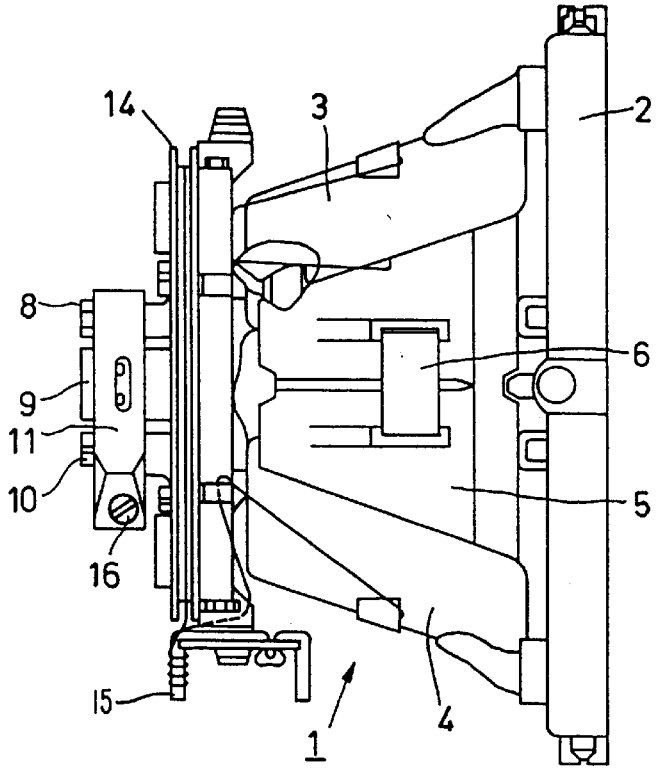
FIG. 2 is a side elevation.
Figure 3:
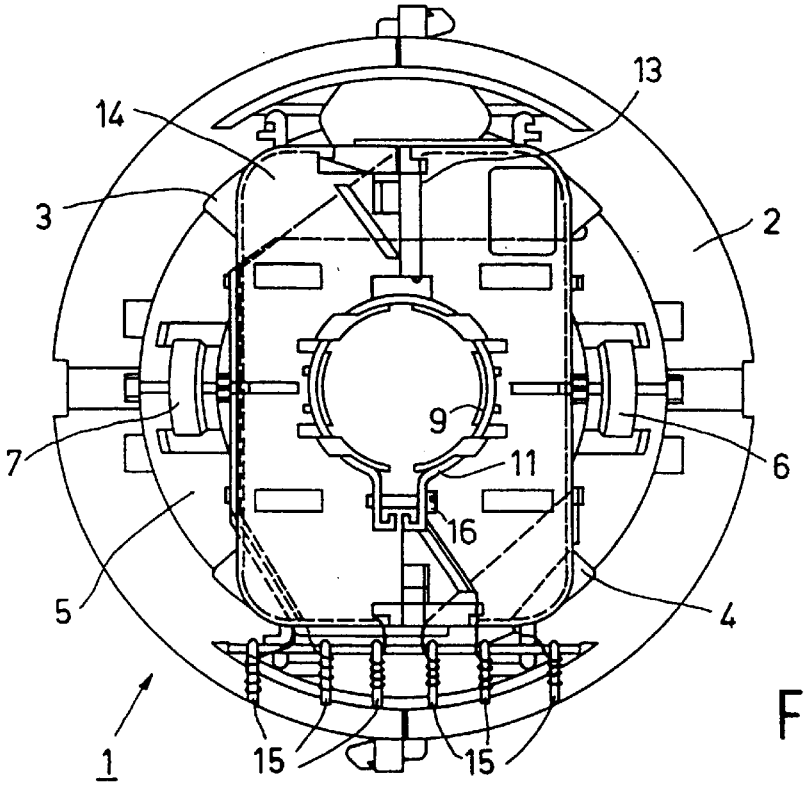
FIG. 3 is a rear view of the deflection unit.

FIGS. 2 and 3 show the deflection unit 1 in greater detail. Deflection unit 1 comprises a hollow synthetic material support 2 having at its inner side a deflection coil not visible) for horizontal deflection of electron beams and at its outer side a deflection coil comprising two coil units 3, 4 for vertical deflection of electron beams. In the relevant case, coil units 3 and 4 are toroidally wound on a yoke ring 5 of a soft-magnetic material. To facilitate winding, the yoke ring 5 comprises two halves which are held together by means of clamping springs 6 and 7. The support 2 has a shape extending from narrow to wide. At its narrow end, the support 2 has projections 8, 9, 10, . . . with which it can be clamped on the neck of a display tube with the aid of a clamping means 11. The clamping means 11 may be made of metal or of a synthetic material.

In the embodiments shown in FIGS. 2 and 3, a flange 14 is moulded on to the support body 2 at a location between the projections and the yoke ring 5. Flange 14 has a circumferential groove in which lead-outs of the deflection coils extend to connection members 15 secured to the flange 14. The clamping means 11 shown in FIGS. 2 and 3 is shown in greater detail in FIG. 5. The clamping means 11 has an open annular shape with a gap at a location on its circumference, at both sides of which gap bent parts of the clamping means outwardly extend as projections 17, 18 located opposite each other. The ends 17*a*, 18*a* of the projections 17, 18 are bent inwards. They may be bent straight inwards or obliquely inwards (not shown). When the bolt 16 is tightened, which bolt has a screw thread cooperating with a screw thread tapped in the wall of an aperture in one of the projections 17, 18, or with a separate nut (not shown), the ends 17*a*, 18*a* move towards each other until they are supported by each other. When the bolt is further tightened, it is achieved that the clamping force exerted by the clamping means 11 on the projections 8, 9, 10 of the coil support is applied as symmetrically as possible in the circumferential direction. This means that the radial clamping forces are as uniform as possible, which reduces the risk of breakage of the glass of the neck 21. Practice proves that in this way the ratio between the exerted clamping force and the maximum glass tension can be enhanced by a factor of 5 to 10. A suitable choice of the material of the clamping means 11 also contributes thereto. As the invention is further based on the recognition that the clamping means 11 should satisfactorily adjust itself around the surface area of the projections 8, 9, 10 . . . (noting that both the tube neck 21 and the cylindrical end of the coil support 2 are never exactly round), a material having a low yield stress is to be preferred. For example, Cu—Zn alloys (brass) and aluminium are suitable. In addition, the described support of the ends of the projections also provides the possibility of using a relatively "soft" material. Such materials would be less usable in other cases.

Figure 4:
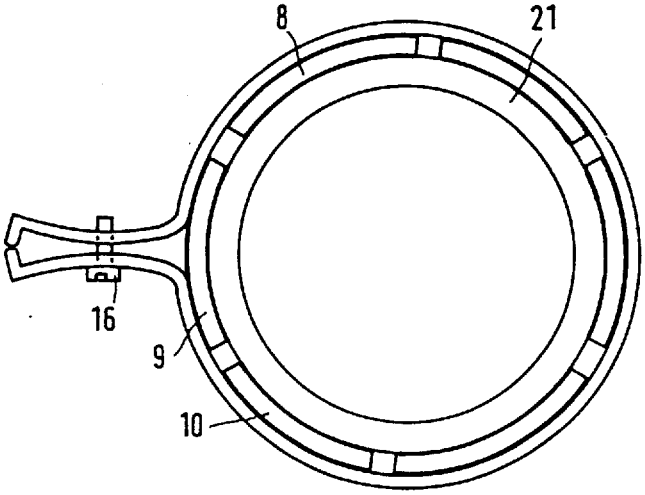
FIG. 4 is an elevational view of a cross-section of a clamping means clamping a coil support on a display tube.
Figure 5:
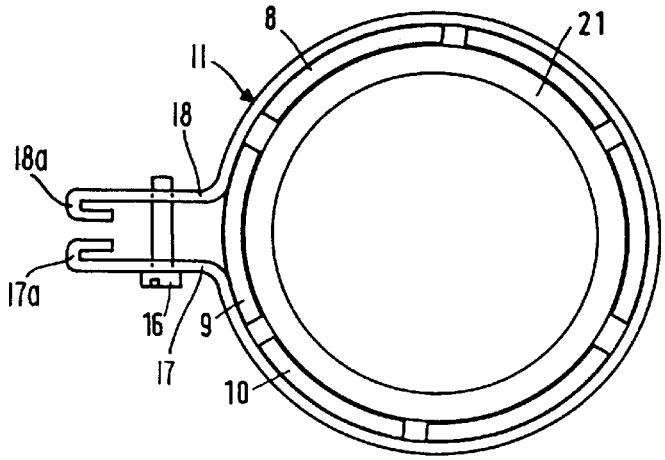
FIG. 5 is an elevational view of a similar cross-section in which, however, an alternative clamping means, which is not yet operational, is used.
Figure 6:
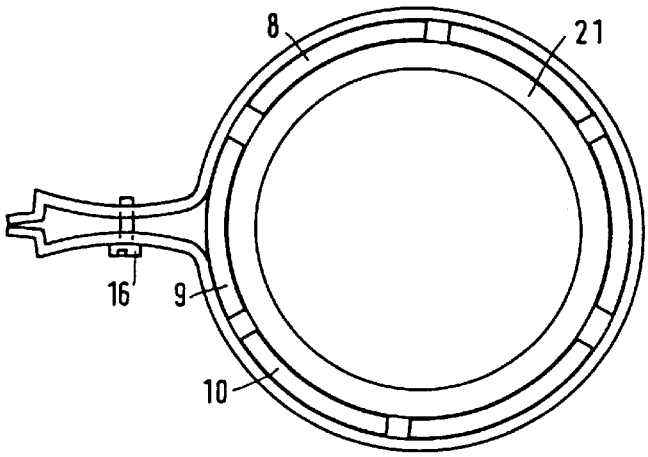
FIGS. 6 and 7 are similar elevational views of further alternative clamping means constructions.
Figure 7:
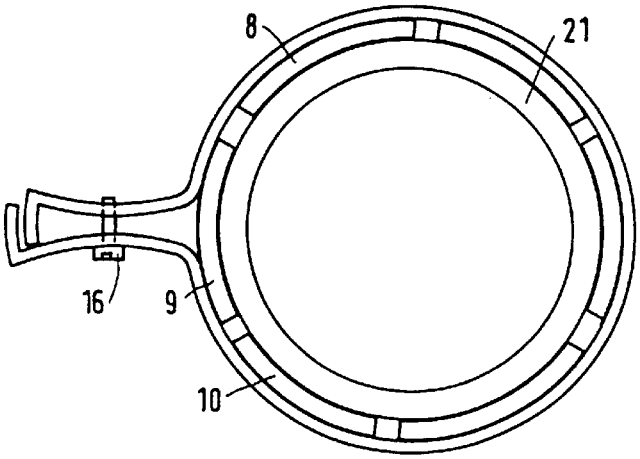

FIG. 4 shows an alternative clamping means construction in which the ends of the projections are bent and are supported by each other in the operational position, but are not bent inwards as in FIG. 5. In the construction shown in FIG. 4 it is therefore more difficult for the bent ends to be exactly supported by each other. In this respect the embodiments shown in FIGS. 6 and 7 have advantages because the supporting faces are larger, viz. in FIG. 6 by first bending the ends inwards at right angles and subsequently bending them away from the ring (instead of towards the ring, as in FIG. 5) and in FIG. 7 by causing the one bent end (at right angles) to fall within the other.

Within the scope of the invention, a suitable soft material for the clamping means is a strip having a thickness of between 0.5 and 1.5 mm of a copper-zinc alloy comprising 35 to 38% by weight of zinc and possibly small additions of iron (max. 0.2%); nickel (max. 0.3%) and/or lead (max. 0.3%). An alternative material is a copper-zinc alloy comprising 28.5 to 31.5% by weight of zinc and possibly small additions of iron (max. 0.1%); nickel (max. 0.3%) and/or lead (max. 0.05%).

Figure 8:
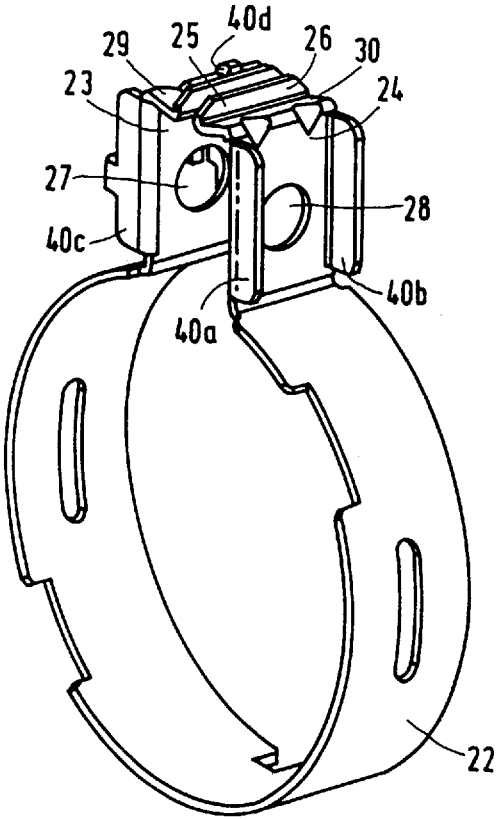
FIGS. 8 and 9 are perspective elevational views of clamping means according to the invention.

FIG. 8 shows an annular clamping means 22 with different "supporting shoulders". In the unclamped ("open") state of the clamping means, the projections 23, 24 extend substantially parallel to each other or diverge to some extent. Their respective ends 29, 30 are not bent or folded inwards at right angles, but obliquely inwards and terminate in parts 25, 26 which are bent back or folded back and extend substantially parallel to each other. In the clamped state of the clamping means 22, the parts 25, 26 support each other. Means for clamping are provided through the apertures 27, 28 in the projections. In the situation shown in FIG. 8 the ends 29, 30 are folded obliquely inwards in the direction of the clamping means 22. Alternatively, the ends 29, 30 may be folded obliquely inwards, away from the clamping means 22.

Figure 9:
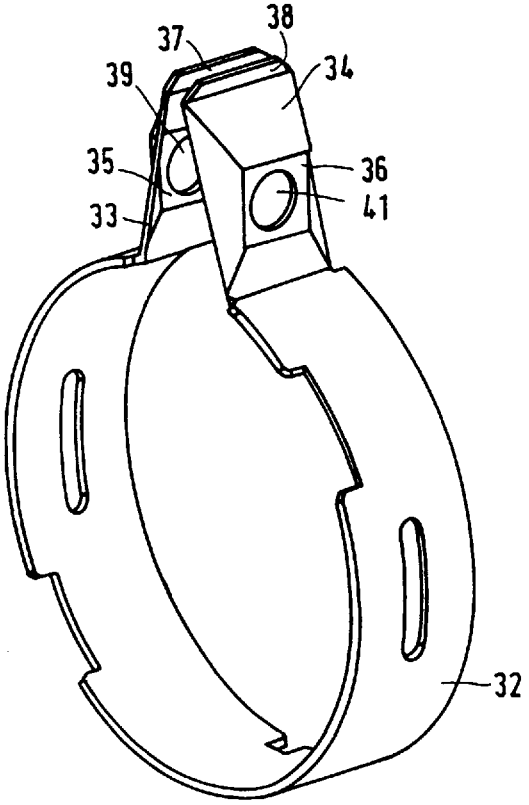
Figure 10:
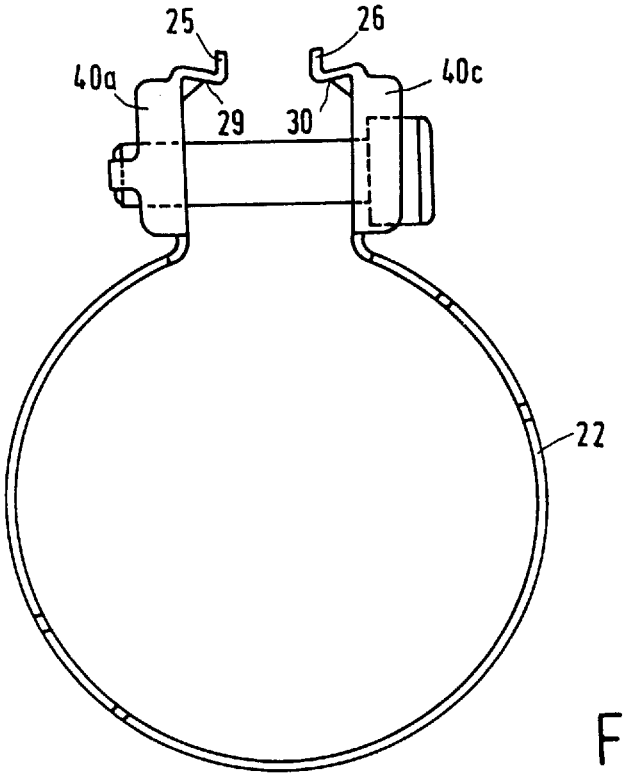
FIG. 10 is a cross-section of a clamping means of the type shown in FIG. 8.

FIG. 9 is a perspective view and FIG. 10 is a cross-section of an annular clamping means 32 in which the projections 33, 34 are not formed by means of a folding process but by means of a drawing process. The projections 33, 34 have the shape of bath tubs whose bottoms 35, 36 face away from each other.

In the open state of the clamping means, the projections 33, 34 extend towards each other (they converge) and have ends 37, 38 which extend substantially parallel to each other. The ends 37, 38 are preferably welded together (in advance). The bottoms 35, 36 have apertures 39, 41 through which clamping means are provided.

As it were, bath tubs whose bottoms face each other are formed by folding the edges 40*a*, 40*b*, 40*c*, 40*d* in the situation where clamping means 22 is used.

As far as the clamping/tension behaviour is concerned, practice proves that the thickness of the clamping means and the way in which the ends of the projections support each other are the most important parameters. It is important to adjust these parameters in such a way that the yield point of the material is approached during the clamping operation. The embodiment shown in FIG. 9 particularly provides the possibility of forming a clamping means from a strip material having a reduced thickness and width, while maintaining the strength. A suitable, thin material to be used is (stainless) steel, particularly austenitic stainless steel having a thickness of 0.6 mm or less. Particulary when the construction shown in FIG. 9 is used, which construction provides extra strength, thicknesses of only 0.4 to 0.5 mm are applicable.

In summary, the invention thus relates to a deflection unit for deflecting the electron beams in a television display tube, which deflection unit comprises a hollow support of synthetic material supporting two deflection coils. At one end, the support is provided with projections surrounded by clamping means for securing the deflection unit to the neck of a display tube. The clamping means has projections located opposite each other, whose mutual distance determining the diameter of the clamping means can be adjusted by tightening a bolt. The ends of the projections are constructed in such a way that the clamping force of the ring is distributed as symmetrically as possible across the surface area of the projections when the bolt is tightened. In a specific embodiment, this construction is realised in such a way that in the operational state, when the bolt has been tightened, the distance between the projections at the display tube side of the bolt is smaller than at the side remote from the display tube.

We claim:

1. A deflection unit for deflecting the electron beams in a cathode ray tube, which deflection unit comprises a hollow support of a synthetic material for supporting deflection coils, one end of said support being provided with projections around which an annular clamping means is arranged for securing the deflection unit to the cathode ray tube, characterized in that the clamping means has an open annular shape with a gap at a location on its circumference, at both sides of which gap bent end parts of the clamping means outwardly extend as projections located opposite each other, in that the ends of the projections include members which extend toward and contact each other when the deflection unit is secured to the cathode ray tube, and in that an adjusting means for decreasing the gap is arranged between the ends of the projections and the gap.

2. A deflection unit as claimed in claim 1, characterized in that in the unclamped state the projections of the clamping means extend substantially parallel to each other or diverge to some extent, and in that the members at the ends of said projections each have a first part which is bent obliquely inwards and a second part which is folded back, the second parts extending substantially parallel to each other.

3. A deflection unit as claimed in claim 1, characterized in that in the unclamped state the projections of the clamping means converge and have free ends which extend substantially parallel to each other.

4. A deflection unit as claimed in claim 3, characterized in that the projections of the clamping means are drawn in the shape of bath tubs and in that the apertures of the bath tubs face each other.

5. A deflection unit as claimed in claim 1, 2, 3 or 4, characterized in that the ends of the projections of the clamping means are welded together.

6. A deflection unit as claimed in claim 1, characterized in that the material of the clamping means is proximate to its yield point in the clamped state.

7. A cathode ray tube comprising a deflection unit for deflecting electron beams in the cathode ray tube, which deflection unit comprises a hollow support of a synthetic material for supporting deflection coils, one end of said support being provided with projections around which an annular clamping means is arranged for securing the deflection unit to the cathode ray tube, characterized in that the clamping means has an open annular shape with a gap at a location on its circumference, at both sides of which gap bent end parts of the clamping means outwardly extend as projections located opposite each other, in that the ends of the projections include members which extend toward and contact each other when the deflection unit is secured to the cathode ray tube, in that an adjusting means for decreasing the gap is arranged between the ends of the projections and the gap, and in that the distance between the projections at the display tube side of the adjusting means is smaller than at the side remote from the display tube.

* * * * *